US010087923B2

(12) United States Patent
Campbell et al.

(10) Patent No.: US 10,087,923 B2
(45) Date of Patent: Oct. 2, 2018

(54) DISC PUMP WITH ADVANCED ACTUATOR

(71) Applicant: The Technology Partnership Plc, Royston, Hertfordshire (GB)

(72) Inventors: Andrew Robert Campbell, Cambridge (GB); Justin Rorke Buckland, Cambridge (GB)

(73) Assignee: The Technology Partnership PLC. (GB)

( * ) Notice: Subject to any disclaimer, the term of this patent is extended or adjusted under 35 U.S.C. 154(b) by 340 days.

(21) Appl. No.: 14/377,366

(22) PCT Filed: Feb. 11, 2013

(86) PCT No.: PCT/GB2013/050306
§ 371 (c)(1),
(2) Date: Aug. 7, 2014

(87) PCT Pub. No.: WO2013/117945
PCT Pub. Date: Aug. 15, 2013

(65) Prior Publication Data

US 2015/0023821 A1 Jan. 22, 2015

(30) Foreign Application Priority Data

Feb. 10, 2012 (GB) ..... 1202346.1

(51) Int. Cl.
*F04B 43/04* (2006.01)
*F04B 45/04* (2006.01)
*F04B 19/00* (2006.01)

(52) U.S. Cl.
CPC ..... *F04B 43/04* (2013.01); *F04B 19/006* (2013.01); *F04B 43/046* (2013.01); *F04B 45/041* (2013.01)

(58) Field of Classification Search
CPC ..... F04B 16/006; F04B 43/04; F04B 43/046; F04B 43/023; F04B 45/041; B41J 2/14209
(Continued)

(56) References Cited

U.S. PATENT DOCUMENTS 6,203,291 B1 3/2001 Stemme et al.
6,582,066 B1 * 6/2003 Temple ..... B41J 2/14209 347/68
(Continued)

FOREIGN PATENT DOCUMENTS

DE 4422743 A1 1/1996
DE 19539020 A1 4/1997
(Continued)

*Primary Examiner* — Dominick L Plakkoottam
*Assistant Examiner* — Connor Tremarche
(74) *Attorney, Agent, or Firm* — Tarolli, Sundheim, Covell & Tummino LLP

(57) ABSTRACT

A fluid pump comprising one or two cavities which, in use, contains a fluid to be pumped, the chamber or chambers having a substantially cylindrical shape bounded by first and second end walls and a side wall; an actuator which, in use, causes oscillatory motion of the first end wall(s) in a direction substantially perpendicular to the plane of the first end wall(s); and whereby, in use, these axial oscillations of the end walls drive radial oscillations of the fluid pressure in the main cavity; and wherein an isolator forms at least a portion of the first end wall between the actuator and the side wall and includes conductive tracks, wherein electrical connection is made to the actuator via the conductive tracks included within the isolator.

18 Claims, 15 Drawing Sheets

(58) Field of Classification Search
USPC ..... 417/413.2, 412
See application file for complete search history.

(56) References Cited

U.S. PATENT DOCUMENTS

| | | | | |
|---|---|---|---|---|
| 2004/0000843 | A1 | 1/2004 | East | |
| 2006/0147324 | A1 | 7/2006 | Tanner et al. | |
| 2006/0159568 | A1* | 7/2006 | Lutz | F04B 43/046 417/412 |
| 2008/0038125 | A1* | 2/2008 | Onishi | F04B 43/023 417/413.2 |
| 2009/0087323 | A1* | 4/2009 | Blakey | F04B 43/046 417/413.2 |
| 2009/0297372 | A1* | 12/2009 | Amirouche | F04B 43/046 417/413.2 |
| 2013/0236338 | A1* | 9/2013 | Locke | F04B 43/023 417/413.1 |

FOREIGN PATENT DOCUMENTS

| | | | | |
|---|---|---|---|---|
| WO | 2005001287 | A1 | 1/2005 | |
| WO | 2006111775 | A1 | 10/2006 | |
| WO | 2009112866 | A1 | 9/2009 | |
| WO | 2010139916 | A1 | 12/2010 | |
| WO | 2010139917 | A1 | 12/2010 | |
| WO | 2010139918 | A1 | 12/2010 | |
| WO | WO 2010139916 | A1 * | 12/2010 | F04B 43/04 |
| WO | WO 2011058140 | A2 * | 5/2011 | A61M 5/14586 |
| WO | 2011095795 | A1 | 8/2011 | |
| WO | 2011097361 | A2 | 8/2011 | |

* cited by examiner

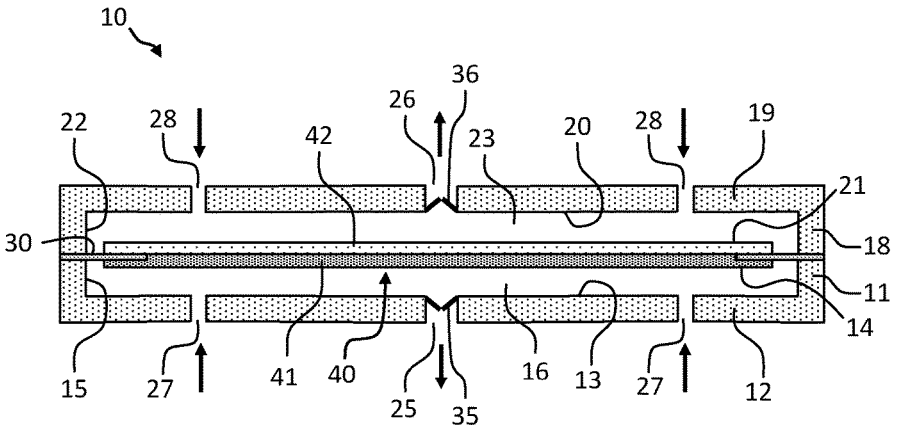
FIG. 1
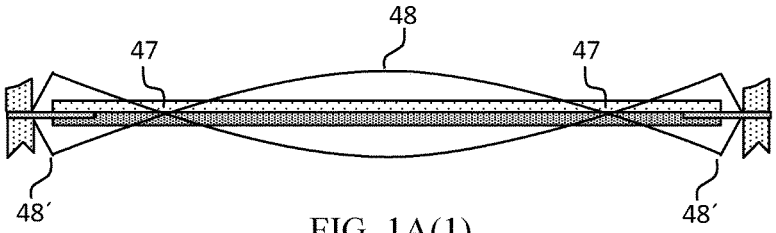
FIG. 1A(1)
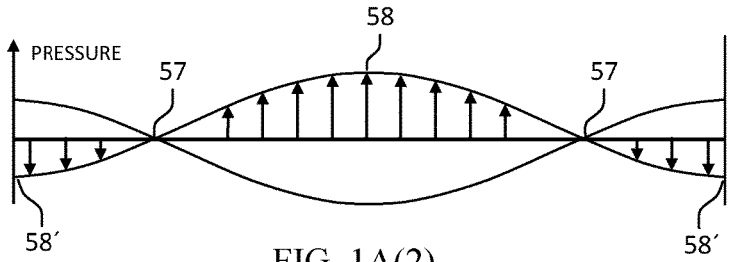
FIG. 1A(2)

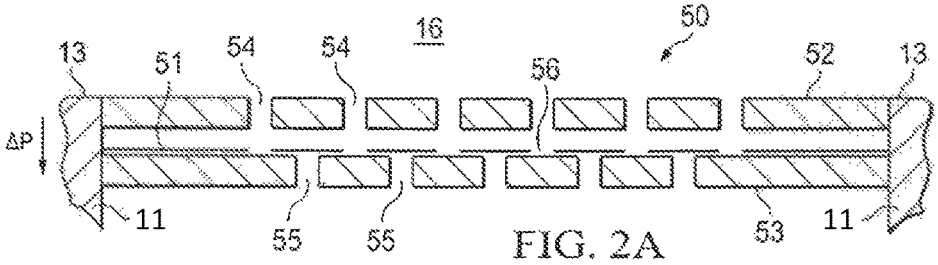
FIG. 2A
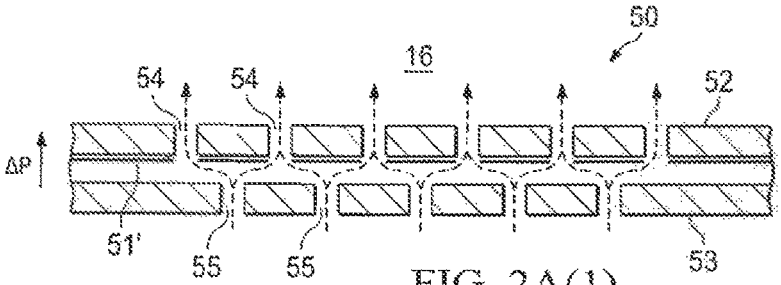
FIG. 2A(1)
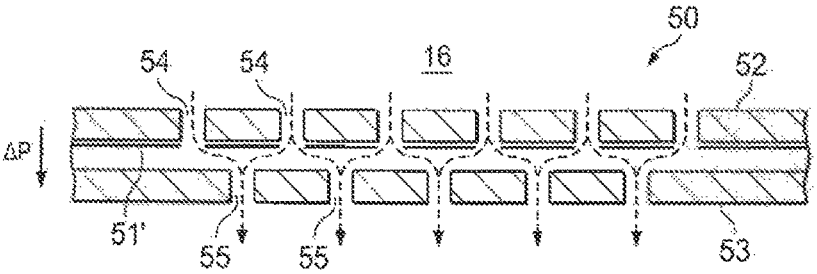
FIG. 2A(2)

DISC PUMP WITH ADVANCED ACTUATOR

BACKGROUND OF THE INVENTION

Field of the Invention

The illustrative embodiments of the invention relate generally to a pump for fluid and, more specifically, to a pump in which each pumping cavity is substantially a disc-shaped, cylindrical cavity having substantially circular end walls and a side wall and which operates via acoustic resonance of fluid within the cavity. More specifically again, the illustrative embodiments of the invention relate to a pump in which the pump actuator embodies an advanced construction bringing substantial benefit to the pump in its construction, integration into products, and operation.

Description of Related Art

It is known to use acoustic resonance to achieve fluid pumping from defined inlets and outlets. This can be achieved using a long cylindrical cavity with an acoustic driver at one end, which drives a longitudinal acoustic standing wave. In such a cylindrical cavity, the acoustic pressure wave has limited amplitude. Varying cross-section cavities, such as cone, horn-cone, bulb have been used to achieve higher amplitude pressure oscillations thereby significantly increasing the pumping effect. In such higher amplitude waves non-linear mechanisms which result in energy dissipation are suppressed by careful cavity design. However, high amplitude acoustic resonance has not been employed within disc-shaped cavities in which radial pressure oscillations are excited until recently. International Patent Application No. PCT/GB2006/001487, published as WO 2006/111775 (the '487 Application), discloses a pump having a substantially disc-shaped cavity with a high aspect ratio, i.e., the ratio of the radius of the cavity to the height of the cavity.

The pump described in the '487 application is further developed in related patent applications PCT/GB2009/050245, PCT/GB2009/050613, PCT/GB2009/050614, PCT/GB2009/050615, PCT/GB2011/050141. These applications and the '487 Application are included herein by reference.

It is important to note that the pump described in the '487 application and the related applications listed above operates on a different physical principle to the majority of pumps described in the prior art. In particular many pumps known in the art are displacement pumps, i.e. pumps in which the volume of the pumping chamber is made smaller in order to compress and expel fluids therefrom through an outlet valve and is increased in size so as to draw fluid therein through an inlet valve. An example of such a pump is described in DE4422743 ("Gerlach"), and further examples of displacement pumps may be found in US2004000843, WO2005001287, DE19539020, and U.S. Pat. No. 6,203,291.

By contrast, the '487 application describes a pump which operates on the principle of acoustic resonance. In such a pump there exist, in operation, pressure oscillations within the pump cavity such that the fluid is compressed within one part of the cavity while the fluid is simultaneously expanded in another part of the cavity. In contrast to more conventional displacement pump an acoustic resonance a pump does not require a change in the cavity volume in order to achieve pumping operation. Instead, its design is adapted to efficiently create, maintain, and rectify the acoustic pressure oscillations within the cavity.

Turning now to its design and operation in greater detail, the '487 Application describes an acoustic resonance pump which has a substantially cylindrical cavity comprising a side wall closed at each end by end walls, one or more of which is a driven end wall. The pump also comprises an actuator that causes an oscillatory motion of the driven end wall ("displacement oscillations") in a direction substantially perpendicular to the end wall or substantially parallel to the longitudinal axis of the cylindrical cavity, referred to hereinafter as "axial oscillations" of the driven end wall. The axial oscillations of the driven end wall generate substantially proportional "pressure oscillations" of fluid within the cavity creating a radial pressure distribution approximating that of a Bessel function of the first kind as described in the '487 Application, such oscillations referred to hereinafter as "radial oscillations" of the fluid pressure within the cavity.

Such a pump requires one or more valves for controlling the flow of fluid through the pump and, more specifically, valves being capable of operating at high frequencies, as it is preferable to operate the pump at frequencies beyond the range of human hearing. Such a valve is described in International Patent Application No. PCT/GB2009/050614.

The efficiency of such a pump is dependent upon the interface between the driven end wall and the side wall. It is desirable to maintain the efficiency of such pump by structuring the interface so that it does not decrease or dampen the motion of the driven end wall thereby mitigating any reduction in the amplitude of the fluid pressure oscillations within the cavity. Patent application PCT/GB2009/050613 (the '613 Application) discloses a pump wherein a portion of the driven end wall between the actuator and the side wall provides an interface that reduces damping of the motion of the driven end wall, that portion being referred to therein and hereinafter as an "isolator". Illustrative embodiments of isolators are shown in the figures of the '613 Application.

More specifically, the pump of the '613 Application comprises a pump body having a substantially cylindrical shape defining a cavity formed by a side wall closed at both ends by substantially circular end walls, at least one of the end walls being a driven end wall having a central portion and a peripheral portion adjacent the side wall, wherein the cavity contains a fluid when in use. The pump further comprises an actuator operatively associated with the central portion of the driven end wall to cause an oscillatory motion of the driven end wall in a direction substantially perpendicular thereto. The pump further comprises an isolator operatively associated with the peripheral portion of the driven end wall to reduce dampening of the displacement oscillations caused by the end wall's connection to the side wall of the cavity. The pump further comprises a first aperture disposed at about the centre of one of the end walls, and a second aperture disposed at any other location in the pump body, whereby the displacement oscillations generate radial oscillations of fluid pressure within the cavity of said pump body causing fluid flow through said apertures.

We now turn to two limiting aspects of the prior art:

Firstly, in operation, the illustrative embodiment of a single-cavity pump shown in FIG. 1A of the '613 Application may generate a net pressure difference across its actuator, putting stress on the bond between the isolator and the pump body and on the bond between the isolator and the actuator component. It is possible that these stresses may lead to failure of one or more of these bonds and it is therefore desirable that they should be strong in order to ensure that the pump delivers a long operational lifetime. Secondly, in order to operate, the single-cavity pump shown in FIG. 1A of the '613 Application requires robust electrical connection to be made to its actuator. This may be achieved by means commonly known in the prior art including by soldered wires or spring contacts which may be conveniently attached the side of the actuator facing away from the pump cavity. However, as disclosed in the '417 Application, a resonant acoustic pump of this kind may also be designed such that two pump cavities are driven by a common driven end wall. Such a two-cavity pump is advantageous as it may deliver increased flow and/or pressure when compared with a single-cavity design, and may deliver increased space, power, or cost efficiency. However in a two-cavity pump it becomes difficult to make electrical contact to the actuator using conventional means without disrupting the acoustic resonance in at least one of the two pump cavities and/or mechanically damping the motion of the actuator. For example, soldered wires or spring contacts may disrupt the acoustic resonance of the cavity in which they are present.

Therefore, for reasons of pump lifetime and performance, a pump construction which achieves a strong bond between the actuator and the isolator, and which facilitates robust electrical connection to the actuator without adversely affecting the resonance of either of the cavities of a two-cavity pump is desirable. The invention described herein describes a combined actuator and isolator assembly which achieves these objectives.

SUMMARY

The design of a combined actuator and isolator is disclosed, suitable for operation with two-cavity resonant acoustic pump designs as described herein and facilitating electrical connection to the actuator.

The combined actuator and isolator overcomes the aforementioned limitations of the prior art while also providing improved manufacturability.

Other objects, features, and advantages of the illustrative embodiments are disclosed herein and will become apparent with reference to the drawings and detailed description that follow.

The present invention provides a pump comprising:

- a pump body having pump walls with a first substantially cylindrical shaped cavity having a side wall closed by two end walls for containing a fluid, the first cavity having a height (h) and a radius (a), wherein a ratio of the radius (a) to the height (h) is greater than about 1.2;
- an actuator operatively associated with a central portion of a first of the two end walls of the first cavity and adapted to cause an oscillatory motion of said first end wall at a frequency (f) thereby generating radial pressure oscillations of the fluid within the first cavity including at least one annular pressure node in response to a drive signal being applied to said actuator;
- a first aperture disposed at a location in one of the two end walls of the first cavity and extending through the pump wall;
- a second aperture disposed at any location in the walls of the first cavity other than the location of the first aperture and extending through the pump wall; and
- a first valve disposed in one of the first and second apertures to enable the fluid to flow through the first cavity when in use; and
- an isolator forming at least a portion of said first end wall between the actuator and the side wall and including conductive tracks
- wherein electrical connection is made to the actuator via said conductive tracks.

The present invention also provides an actuator assembly for a pump cavity, the assembly comprising:

- an actuator having at least two layers, at least one of which is formed from an active material; and
- an isolator extending radially away from the actuator for, in use, engagement with the walls of a pump cavity,
- wherein the isolator has at least one conductive track in electrical connection with at least one of the active layers, enabling an electrical connection to be made to the actuator from outside the pump cavity.

The present invention also provides an actuator assembly for a pump cavity, the assembly comprising:

- an actuator having at least two layers, at least one of which is formed from an active material; and
- an isolator extending radially away from the actuator for, in use, engagement with the walls of a pump cavity, wherein part of the isolator is sandwiched between two of the layers.

The isolator may alternatively be joined to an outer side of any of the layers of the pump.

BRIEF DESCRIPTION OF THE DRAWINGS

FIG. 1 shows a two-cavity pump which includes a combined actuator and isolator assembly according to the present invention.

FIGS. 1A(1) and 1A(2) show, respectively, a graph of the displacement oscillations of the driven end wall of the pump, and a graph of the pressure oscillations within the cavity of the pump of FIG. 1.

FIG. 2A shows a schematic cross-section view of a valve for use with the pumps according to the illustrative embodiments of the invention.

FIGS. 2A(1) and 2A(2) show a section of the valve of FIG. 2A in operation.

DETAILED DESCRIPTION OF ILLUSTRATIVE EMBODIMENTS

In the following detailed description of several illustrative embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1B:
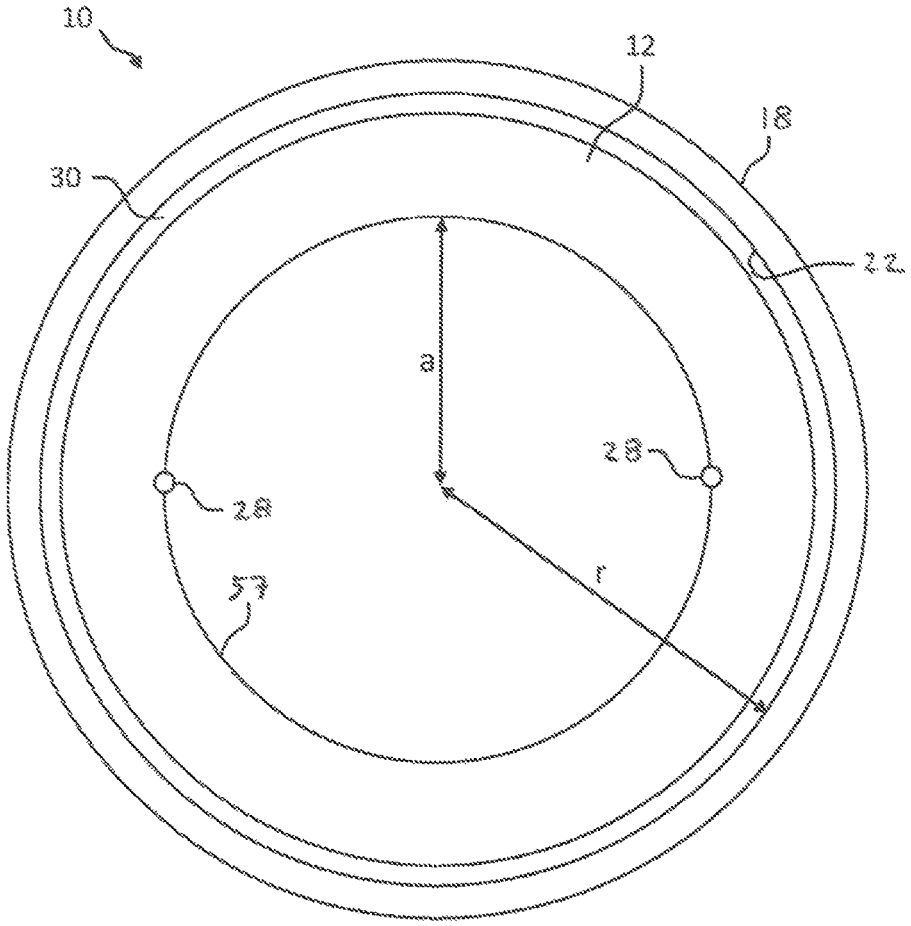
FIG. 1B shows a plan view of the pump shown in FIG. 1A.

FIG. 1A is a schematic cross-section of a two-cavity pump 10 according to the present invention. Referring also to FIG. 1B, pump 10 comprises a first pump body having a substantially cylindrical shape including a cylindrical wall 11 closed at one end by a base 12 and closed at the other end by an end plate 41 and a ring-shaped isolator 30 disposed between the end plate 41 and the other end of the cylindrical wall 11 of the first pump body. The cylindrical wall 11 and base 12 may be a single component comprising the first pump body. Pump 10 also comprises a second pump body having a substantially cylindrical shape including a cylindrical wall 18 closed at one end by a base 19 and closed at the other end by a piezoelectric disc 42 and the ring-shaped isolator 30 disposed between the end plate 42 and the other end of the cylindrical wall 18 of the second pump body. The cylindrical wall 18 and base 19 may be a single component comprising the second pump body. The first and second pump bodies may be mounted to other components or systems.

The internal surfaces of the cylindrical wall 11, the base 12, the end plate 41, and the isolator 30 form a first cavity 16 within the pump 10 wherein said first cavity 16 comprises a side wall 15 closed at both ends by end walls 13 and 14. The end wall 13 is the internal surface of the base 12 and the side wall 15 is the inside surface of the cylindrical wall 11. The end wall 14 comprises a central portion corresponding to a surface of the end plate 41 and a peripheral portion corresponding to a first surface of the isolator 30. Although the first cavity 16 is substantially circular in shape, the first cavity 16 may also be elliptical or other suitable shape. The internal surfaces of the cylindrical wall 18, the base 19, the piezoelectric disc 42, and the isolator 30 form a second cavity 23 within the pump 10 wherein said second cavity 23 comprises a side wall 22 closed at both ends by end walls 20 and 21. The end wall 20 is the internal surface of the base 19 and the side wall 22 is the inside surface of the cylindrical wall 18. The end wall 21 comprises a central portion corresponding to the inside surface of the piezoelectric disc 42 and a peripheral portion corresponding to a second surface of the isolator 30. Although the second cavity 23 is substantially circular in shape, the second cavity 23 may also be elliptical or other suitable shape. The cylindrical walls 11, 18 and the bases 12, 19 of the first and second pump bodies may be formed from any suitable rigid material including, without limitation, metal, ceramic, glass, or plastic.

The pump 10 also comprises a piezoelectric disc 42 operatively connected to the end plate 41 to form an actuator 40 that is operatively associated with the central portion of the end walls 14 and 21 via the end plate 41 and the piezoelectric disc 42. The piezoelectric disc 42 is not required to be formed of a piezoelectric material, but may be formed of any electrically active material such as, for example, an electrostrictive or magnetostrictive material. As such, the term "piezoelectric disc" is intended to cover electrostrictive or magnetostrictive discs as well. The end plate 41 preferably possesses a bending stiffness similar to the piezoelectric disc 42 and may be formed of an electrically inactive material such as a metal or ceramic. When the piezoelectric disc 42 is excited by an oscillating electrical current, the piezoelectric disc 42 attempts to expand and contract in a radial direction relative to the longitudinal axis of the cavities 16, 23 causing the actuator 40 to bend, thereby inducing an axial deflection of the end walls 14, 21 in a direction substantially perpendicular to the end walls 14, 21. The end plate 41 alternatively may also be formed from an electrically active material such as, for example, a piezoelectric, magnetostrictive, or electrostrictive material. In another embodiment, the actuator 40 may be replaced by a single plate in force-transmitting relation with an actuation device, for example, a mechanical, magnetic or electrostatic device, wherein said plate forms the end walls 14, 21 and said plate may be formed as an electrically inactive or passive layer of material driven into oscillation by such device (not shown) in the same manner as described above.

The pump 10 further comprises at least two apertures extending from the first cavity 16 to the outside of the pump 10, wherein at least a first one of the apertures may contain a valve to control the flow of fluid through the aperture. Although the aperture containing a valve may be located at any position in the cavity 16 where the actuator 40 generates a pressure differential as described below in more detail, one preferred embodiment of the pump 10 comprises an aperture with a valve located at approximately the centre of the end wall 13. The pump 10 shown in FIGS. 1A and 1B comprises a primary aperture 25 extending from the cavity 16 through the base 12 of the pump body at about the centre of the end wall 13 and containing a valve 35. The valve 35 is mounted within the primary aperture 25 and permits the flow of fluid in one direction as indicated by the arrow so that it functions as an outlet for the pump 10. The second aperture 27 may be located at any position within the cavity 11 other than the location of the aperture 25 with the valve 35. In one preferred embodiment of the pump 10, the second aperture is disposed between the centre of the end wall 13 and the side wall 15. The embodiment of the pump 10 shown in FIGS. 1A and 1B comprises two secondary apertures 27 extending from the cavity 11 through the base 12 that are disposed between the centre of the end wall 13 and the side wall 15.

The pump 10 further comprises at least two apertures extending from the cavity 23 to the outside of the pump 10, wherein at least a first one of the apertures may contain a valve to control the flow of fluid through the aperture. Although the aperture containing a valve may be located at any position in the cavity 23 where the actuator 40 generates a pressure differential as described below in more detail, one preferred embodiment of the pump 10 comprises an aperture with a valve located at approximately the centre of the end wall 20. The pump 10 shown in FIGS. 1A and 1B comprises a primary aperture 26 extending from the cavity 23 through the base 19 of the pump body at about the centre of the end wall 20 and containing a valve 36. The valve 36 is mounted within the primary aperture 26 and permits the flow of fluid in one direction as indicated by the arrow so that it functions as an outlet for the pump 10. The second aperture 28 may be located at any position within the cavity 23 other than the location of the aperture 26 with the valve 36. In one preferred embodiment of the pump 10, the second aperture is disposed between the centre of the end wall 20 and the side wall 22. The embodiment of the pump 10 shown in FIGS. 1A and 1B comprises two secondary apertures 28 extending from the cavity 23 through the base 19 that are disposed between the centre of the end wall 20 and the side wall 22.

Although the secondary apertures 27, 28 are not valved in this embodiment of the pump 10, they may also be valved to improve performance if necessary. In this embodiment of the pump 10, the primary apertures 25, 26 are valved so that the fluid is drawn into the cavities 16, 23 of the pump 10 through the secondary apertures 27, 28 and pumped out of the cavities 16, 23 through the primary aperture 25, 26 as indicated by the arrows.

The valves 35 and 36 allow fluid to flow through in substantially one direction as described above. The valves 35 and 36 may be a ball valve, a diaphragm valve, a swing valve, a duck-bill valve, a clapper valve, a lift valve, or any other type of check valve or any other valve that allows fluid to flow substantially in only one direction. Some valve types may regulate fluid flow by switching between an open and closed position. For such valves to operate at the high frequencies generated by the actuator 40, the valves 35 and 36 must have an extremely fast response time such that they are able to open and close on a timescale significantly shorter than the timescale of the pressure variation. One embodiment of the valves 35 and 36 achieves this by employing an extremely light flap valve which has low inertia and consequently is able to move rapidly in response to changes in relative pressure across the valve structure.

Figure 2B:
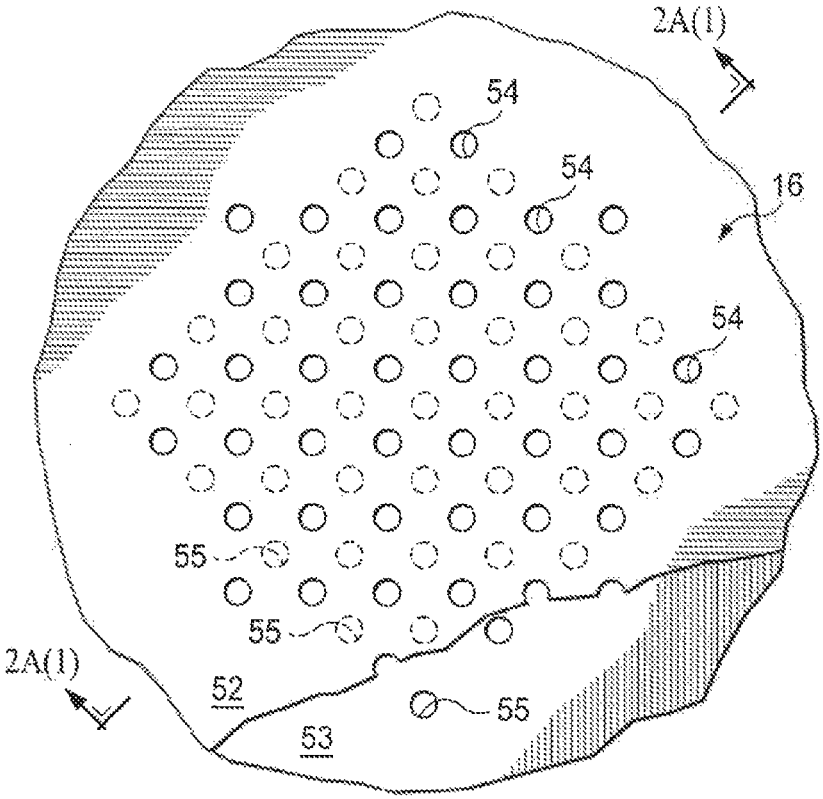
FIG. 2B shows a schematic top view of the valve of FIG. 2A.

Referring more specifically to FIG. 2A, a schematic cross-section view of one embodiment of a flap valve 50 is shown mounted within the aperture 25. The flap valve 50 comprises a flap 51 disposed between a retention plate 52 and a sealing plate 53 and biased against the sealing plate 53 in a "closed" position which seals the flap valve 50 when not in use, i.e., the flap valve 50 is normally closed. The valve 50 is mounted within the aperture 25 so that the upper surface of the retention plate 52 is preferably flush with the inner surface of the end wall 13 to maintain the resonant quality of the cavity 16. The retention plate 52 and the sealing plate 53 both have vent holes 54 and 55 respectively that extend from one side of the plate to the other as represented by the dashed and solid circles, respectively, in FIG. 2B which is a top view of the flap valve 50 of FIG. 2A. The flap 51 also has vent holes 56 which are generally aligned with the vent holes 54 of the retention plate 52 to provide a passage through which fluid may flow as indicated by the dashed arrows in FIG. 2A(1). However, as can be seen in FIGS. 2A and 2B, the vent holes 54 of the retention plate 52 and the vent holes 56 of the flap 51 are not in alignment with the vent holes 55 of the sealing plate 53 which are blocked by the flap 51 when in the "closed" position as shown so that fluid cannot flow through the flap valve 50.

The operation of the flap valve 50 is a function of the change in direction of the differential pressure ($\Delta P$) of the fluid across the flap valve 50. In FIG. 2A, the differential pressure has been assigned a negative value ($-\Delta P$) as indicated by the downward pointing arrow. This negative differential pressure ($-\Delta P$) drives the flap 51 into the fully closed position as described above wherein the flap 51 is sealed against the sealing plate 53 to block the vent holes 55 and prevent the flow of fluid through the flap valve 50. When the differential pressure across the flap valve 50 reverses to become a positive differential pressure ($+\Delta P$) as indicated by the upward pointing arrow in FIG. 2A(1), the biased flap 51 is motivated away from the sealing plate 53 against the retention plate 52 into an "open" position. In this position, the movement of the flap 51 unblocks the vent holes 55 of the sealing plate 53 so that fluid is permitted to flow through vent holes 55 and then the aligned vent holes 56 of the flap 51 and vent holes 54 of the retention plate 52 as indicated by the dashed arrows. When the differential pressure changes back to a negative differential pressure ($-\Delta P$) as indicated by the downward pointing arrow in FIG. 2A(2), fluid begins flowing in the opposite direction through the flap valve 50 as indicated by the dashed arrows which forces the flap 51 back toward the closed position shown in FIG. 2A. Thus, the changing differential pressure cycles the flap valve 50 between closed and open positions to block the flow of fluid after closing the flap 51 when the differential pressure changes from a positive to a negative value. It should be understood that flap 51 could be biased against the retention plate 52 in an "open" position when the flap valve 50 is not in use depending upon the application of the flap valve 50, i.e., the flap valve would then be normally open.

Referring to FIG. 3, the pump 10 of FIG. 1 is shown with alternative configurations of its apertures. FIG. 3A shows the pump 10 of FIG. 1 in outline schematic form, indicating the locations of the inlet apertures 27 and 28 and outlet apertures 25 and 26 of the two cavities 15 and 23, together with the valves 35 and 36 located in the apertures 25 and 26 respectively. FIG. 3B shows an alternative configuration in which the valves 35' and 36' in the primary apertures 25' and 26' of pump 60 are reversed so that the fluid is drawn into the cavities 16 and 23 through the primary apertures 25' and 26' and expelled out of the cavities 16 and 23 through the secondary apertures 27 and 28 as indicated by the arrows, thereby providing suction or a source of reduced pressure at the primary apertures 25' and 26'. The term "reduced pressure" as used herein generally refers to a pressure less than the ambient pressure where the pump 10 is located. Although the term "vacuum" and "negative pressure" may be used to describe the reduced pressure, the actual pressure reduction may be significantly less than the pressure reduction normally associated with a complete vacuum. The pressure is "negative" in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure.

Figure 3A:
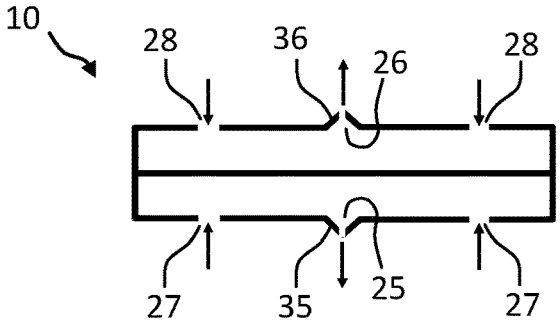
FIGS. 3A, 3B, 3C, and 3D show schematic cross sections of two-cavity pumps having various inlet and outlet configurations.
Figure 3B:
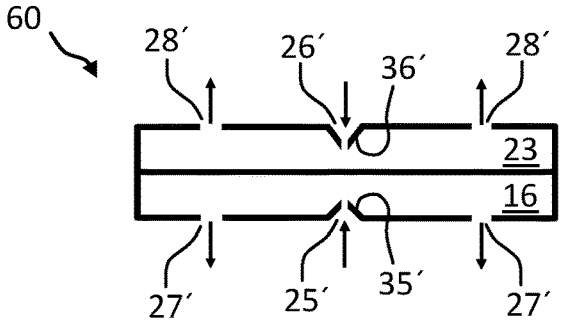
Figure 3C:
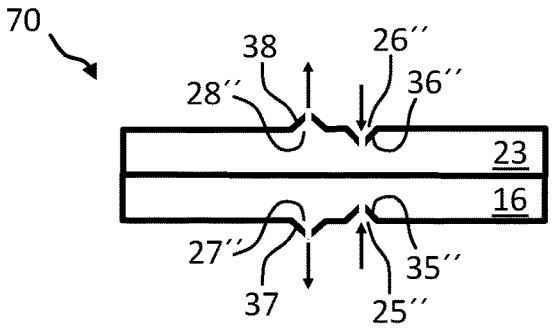

FIG. 3C shows a further alternative configuration in which both the primary and secondary apertures in the cavities 16 and 23 of the pump 70 are located close to the centers of the end walls of the cavities. In this configuration both the primary and secondary apertures are valved as shown so that the fluid is drawn into the cavities 16 and 23 through the primary apertures 25" and 26" and expelled out of the cavities 16 and 23 through the secondary apertures 27" and 28". One skilled in the art will recognize that the two-valve configuration shown schematically in FIG. 3C can enable full-wave rectification of the pressure oscillations in the cavities 16 and 23, whereas the designs shown in FIGS. 3A and 3B are able to deliver only half-wave rectification. The pump of FIG. 3C is therefore able to deliver a higher differential pressure than the pumps of FIGS. 3A and 3B under the same drive conditions.

Figure 3D:
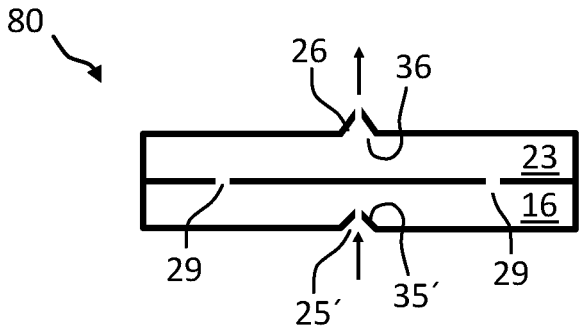

FIG. 3D shows a further alternative configuration in which the primary apertures in the cavities 16 and 23 of the pump 80 are located close to the centers of the end walls of the cavities and the secondary apertures 29 connect cavities 16 and 23. This configuration provides a convenient method of connecting the two cavities of the pump 80 in series.

In each of the two-cavity pumps described above the two cavities may be considered as separate pumping units, albeit driven by the same actuator and therefore not independently controllable. These two units may be connected in series or parallel in order to deliver increased pressure or increased flow respectively through the use of an appropriate manifold. Such manifold may be incorporated into the pump body components 11, 12, 18 and 19 to facilitate assembly and to reduce the number of parts required in order to assemble the pump.

Figure 4:
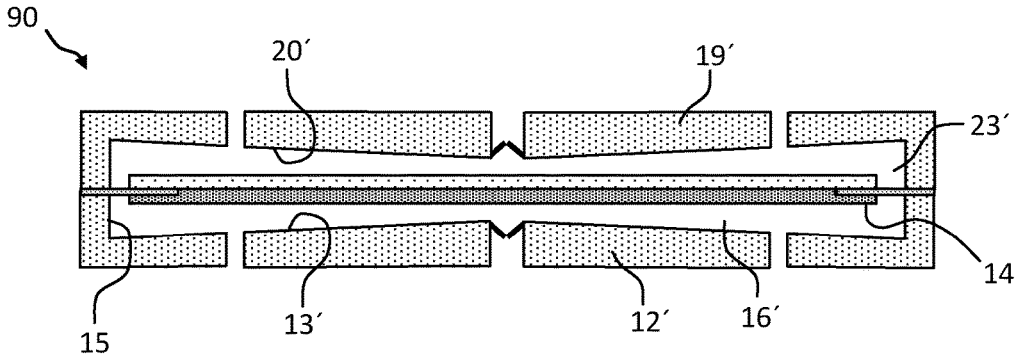
FIG. 4 shows a schematic cross section of a two-cavity pump according to the present invention in which end walls of the cavities are frusto-conical in shape.

Referring now to FIG. 4, a pump 90 according to another illustrative embodiment of the invention is shown. The pump 90 is substantially similar to the pump 10 of FIG. 1 except that the pump body has a base 12' having an upper surface forming the end wall 13' which is frusto-conical in shape. Consequently, the height of the cavity 16' varies from the height at the side wall 15 to a smaller height between the end walls 13', 14 at the centre of the end walls 13', 14. The frusto-conical shape of the end wall 13' intensifies the pressure at the centre of the cavity 16' where the height of the cavity 16' is smaller relative to the pressure at the side wall 15 of the cavity 16' where the height of the cavity 16' is larger. Therefore, comparing cylindrical and frusto-conical cavities 16 and 16' having equal central pressure amplitudes, it is apparent that the frusto-conical cavity 16' will generally have a smaller pressure amplitude at positions away from the centre of the cavity 16': the increasing height of the cavity 16' acts to reduce the amplitude of the pressure wave. As the viscous and thermal energy losses experienced during the oscillations of the fluid in the cavity 16' both increase with the amplitude of such oscillations, it is advantageous to the efficiency of the pump 90 to reduce the amplitude of the pressure oscillations away from the centre of the cavity 16' by employing a frusto-conical cavity 16' design. In one illustrative embodiment of the pump 90 where the diameter of the cavity 16' is approximately 20 mm, the height of the cavity 16' at the side wall 15 is approximately 1.0 mm tapering to a height at the centre of the end wall 13' of approximately 0.3 mm. Either one of the end walls 13' or 20' may have a frusto-conical shape.

The dimensions of the pumps described herein should preferably satisfy certain inequalities with respect to the relationship between the height (h) of the cavities 16 and 23 and the radius (a) of the cavities 16 and 23 which is the distance from the longitudinal axis of the cavity to its respective side wall 15, 22. These equations are as follows:

$a/h>1.2$; and $h^2/a>4\times10^{-10}$ meters.

In one embodiment of the invention, the ratio of the cavity radius to the cavity height (a/h) is between about 10 and about 50 when the fluid within the cavities 16, 23 is a gas. In this example, the volume of the cavities 16, 23 may be less than about 10 ml. Additionally, the ratio of $h^2/a$ is preferably within a range between about $10^{-3}$ and about $10^{-6}$ meters where the working fluid is a gas as opposed to a liquid.

In one embodiment of the invention the secondary apertures 27, 28 are located where the amplitude of the pressure oscillations within the cavities 16, 23 is close to zero, i.e., the "nodal" points 19 of the pressure oscillations as indicated in FIG. 1A(2). Where the cavities 16, 23 are cylindrical, the radial dependence of the pressure oscillation may be approximated by a Bessel function of the first kind and the radial node of the lowest-order pressure oscillation within the cavity occurs at a distance of between approximately 0.43a and 0.83a, and more usually close to 0.63a from the centre of the end walls 13, 20 or the longitudinal axis of the cavities 16, 23. Thus, the secondary apertures 27, 28 are preferably located at a radial distance (r) from the centre of the end walls 13, 20, where (r) is between approximately 0.43a and 0.83a, and more preferably close to 0.63a, i.e., close to the nodal points of the pressure oscillations.

Additionally, the pumps disclosed herein should preferably satisfy the following inequality relating the cavity radius (a) and operating frequency (f) which is the frequency at which the actuator 40 vibrates to generate the axial displacement of the end walls 14, 21. The inequality equation is as follows:

$$\frac{k_0(c_s)}{2\pi f} \le a \le \frac{k_0(c_f)}{2\pi f}$$

wherein the speed of sound in the working fluid within the cavities 16, 23, (c) may range between a slow speed ($c_s$) of about 115 m/s and a fast speed ($c_f$) equal to about 1,970 m/s as expressed in the equation above, and $k_0$ is a constant ($k_0$=3.83). The frequency of the oscillatory motion of the actuator 40 is preferably about equal to the lowest resonant frequency of radial pressure oscillations in the cavities 16, 23, but may be within 20% therefrom. The lowest resonant frequency of radial pressure oscillations in the cavities 16, 23 is preferably greater than 500 Hz.

Referring now to the pump 10 in operation, the piezoelectric disc 42 is excited to expand and contract in a radial direction against the end plate 41 which causes the actuator 40 to bend, thereby inducing an axial displacement of the driven end walls 14, 21 in a direction substantially perpendicular to the driven end walls 14, 21. The actuator 40 is operatively associated with the central portion of the end walls 14, 21 as described above so that the axial displacement oscillations of the actuator 40 cause axial displacement oscillations along the surface of the end walls 14, 21 with maximum amplitudes of oscillations, i.e., anti-node displacement oscillations, at about the centre of the end walls 14, 21. Referring back to FIG. 1A, the displacement oscillations and the resulting pressure oscillations of the pump 10 as generally described above are shown more specifically in FIGS. 1A(1) and 1A(2), respectively. The phase relationship between the displacement oscillations and pressure oscillations may vary, and a particular phase relationship should not be implied from any figure.

FIG. 1A(1) shows one possible displacement profile illustrating the axial oscillation of the driven end walls 14, 21 of the cavities 16, 23. The solid curved line and arrows represent the displacement of the driven end walls 14, 21 at one point in time, and the dashed curved line represents the displacement of the driven end walls 14, 21 one half-cycle later. The displacement as shown in this figure and the other figures is exaggerated. Because the actuator 40 is not rigidly mounted at its perimeter, but rather suspended by the isolator 30, the actuator 40 is free to oscillate about its centre of mass in its fundamental mode. In this fundamental mode, the amplitude of the displacement oscillations of the actuator 40 is substantially zero at an annular displacement node 47 located between the centre of the end walls 14, 21 and the corresponding side walls 15, 22. The amplitudes of the displacement oscillations at other points on the end walls 14, 21 have amplitudes greater than zero as represented by the vertical arrows. A central displacement anti-node 48 exists near the centre of the actuator 40 and peripheral displacement anti-node 48' exists near the perimeter of the actuator 40.

FIG. 1A(2) shows one possible pressure oscillation profile illustrating the pressure oscillations within the cavities 16, 23 resulting from the axial displacement oscillations shown in FIG. 1A(1). The solid curved line and arrows represent the pressure at one point in time, and the dashed curved line represents the pressure one half-cycle later. In this mode and higher-order modes, the amplitude of the pressure oscillations has a central pressure anti-node 58 near the centre of the cavities 16, 23 and a peripheral pressure anti-node 58' near the side walls 15, 22 of the cavities 16, 23. The amplitude of the pressure oscillations is substantially zero at the annular pressure node 57 between the pressure anti-nodes 58 and 58'. For a cylindrical cavity the radial dependence of the amplitude of the pressure oscillations in the cavities 16, 23 may be approximated by a Bessel function of the first kind. The pressure oscillations described above result from the radial movement of the fluid in the cavities 16, 23, and so will be referred to as "radial pressure oscillations" of the fluid within the cavities 16, 23 as distinguished from the axial displacement oscillations of the actuator 40.

With reference to FIGS. 1A(1) and 1A(2), it can be seen that the radial dependence of the amplitude of the axial displacement oscillations of the actuator 40 (the "mode-shape" of the actuator 40) should approximate a Bessel function of the first kind so as to match more closely the radial dependence of the amplitude of the desired pressure oscillations in the cavities 16, 23 (the "mode-shape" of the pressure oscillation). By not rigidly mounting the actuator 40 at its perimeter and allowing it to vibrate more freely about its centre of mass, the mode-shape of the displacement oscillations substantially matches the mode-shape of the pressure oscillations in the cavities 16, 23, thus achieving mode-shape matching or, more simply, mode-matching. Although the mode-matching may not always be perfect in this respect, the axial displacement oscillations of the actuator 40 and the corresponding pressure oscillations in the cavities 16, 23 have substantially the same relative phase across the full surface of the actuator 40 wherein the radial position of the annular pressure node 57 of the pressure oscillations in the cavities 16, 23 and the radial position of the annular displacement node 47 of the axial displacement oscillations of actuator 40 are substantially coincident.

One skilled in the art will recognize that the speed of sound in the fluid in each cavity may vary with temperature, and thus that the resonant frequency of each cavity may also vary with temperature. It may therefore be preferable to arrange for the two cavities to be of different diameters such that each cavity performs optimally at a different temperature. In this way the performance of the pump as a whole may be made more stable as a function of temperature, providing a wider useful operating temperature range.

We turn now to the detailed construction of the combined actuator and isolator.

Figure 5A:
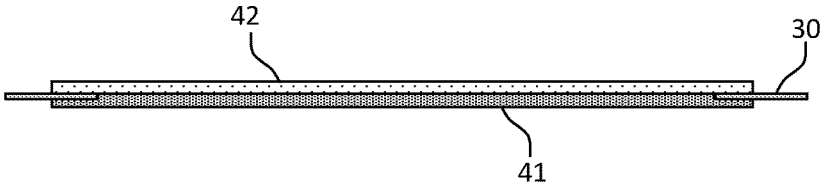
FIG. 5A shows a schematic cross section of a combined actuator and isolator assembly according to the present invention.
Figure 5B:
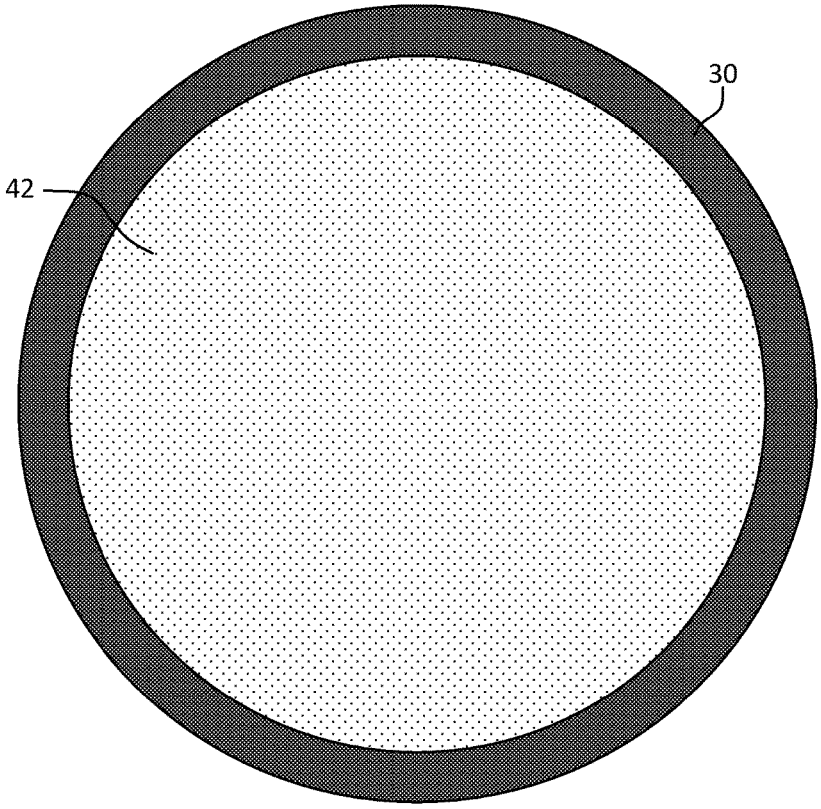
FIG. 5B shows a plan view of the combined actuator and isolator assembly of FIG. 5A.

FIG. 5A shows a schematic cross-section view of a combined actuator and isolator according to the present invention. The isolator 30 is sandwiched between the piezoelectric disc 42 and the end plate 41 to form a subassembly. The bonds between the isolator 30, end plate 41 and piezoelectric disc 42 may be formed by any suitable method including without limitation gluing. The fact that the isolator 30 is held between the piezoelectric disc 42 and the end plate 41 makes the connection between the isolator and these two parts extremely strong, which is important where there may be a pressure difference across the assembly as described earlier herein.

Figure 6:
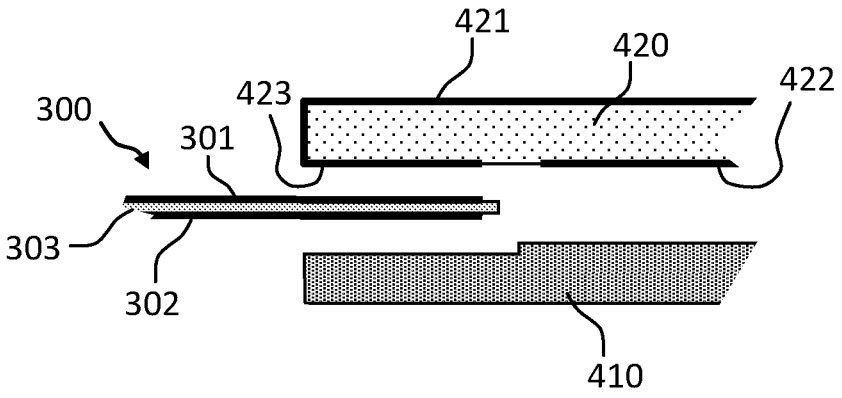
FIG. 6 shows an exploded cross section view of a detail of a combined actuator and isolator assembly according to the present invention.

FIG. 6 shows a schematic exploded cross-section view of a combined actuator and isolator according to the present invention which includes provision for electrical connection to be made to the actuator. The piezoelectric disc 420 has metal electrodes 421 and 422 on its upper and lower surfaces and the upper electrode 421 is "wrapped" around the edge of the actuator in at least one location around its circumference to bring a portion of the upper electrode 421 onto the lower surface of the piezoelectric disc 420. We refer to this section of the upper electrode 421 as the "wrap electrode" 423. In operation a voltage is applied across the electrodes 421 and 422 resulting in an electric field being set up between the upper electrode 421 and the lower electrode 422 in a substantially axial direction. The piezoelectric disc 420 is polarized such that the axial electric field causes the piezoelectric disc 420 to expand or contract in a radial direction depending on the sign of the electric field applied. One skilled in the art will recognize that where the wrap electrode 423 is present on the lower surface of the piezoelectric disc 420 no such axial field will be created and the effectiveness of the actuator is reduced. For this reason the wrap electrode 423 should not extend over a significant part of the lower surface of the piezoelectric disc 420.

Referring again to FIG. 6, the isolator 300 is comprised of a flexible, electrically non-conductive core 303 with conductive electrodes 301 and 302 on its upper and lower surfaces. The upper electrode 301 connects with the wrap electrode 423 and thereby with the upper electrode 421 of the piezoelectric disc 420. The lower electrode 302 connects with the end plate 410 and thereby with the lower electrode 422 of the piezoelectric disc 420. In this case the end plate 410 should be formed from an electrically conductive material. In a preferred embodiment the actuator 40 comprises a steel or aluminium end plate 410 of between 5 mm and 20 mm radius and between 0.1 mm and 3 mm thickness bonded to a piezoceramic disc 420 of similar dimensions, the isolator core 303 is a formed from polyimide with a thickness of between 5 microns and 200 microns and the upper and lower isolator electrodes are formed from copper having a thickness of between 3 microns and 50 microns. More preferably the actuator 40 comprises a steel or aluminium end plate 410 of around 10 mm radius and around 0.5 mm thickness bonded to a piezoceramic disc 420 of similar dimensions, the isolator core 303 is a formed from polyimide with a thickness of around 25 microns and the upper and lower isolator electrodes are formed from copper having a thickness of around 9 microns. Further "capping" layers of polyimide (not shown) may be applied selectively to the isolator to insulate the electrodes and to provide robustness.

Figure 7A:
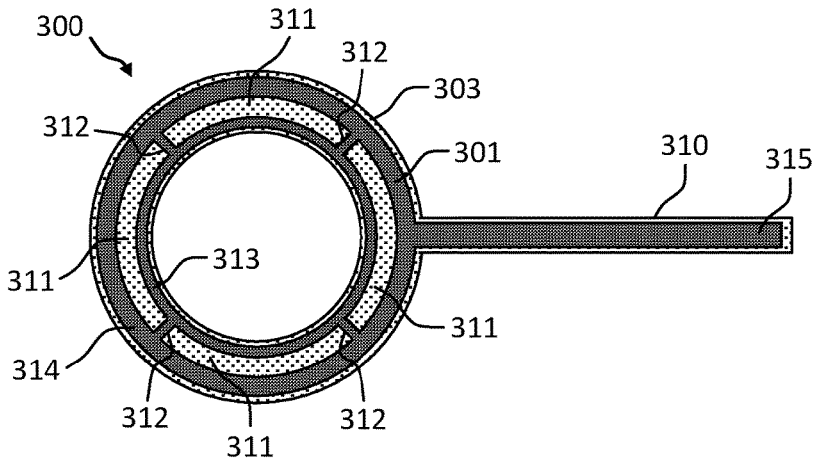
FIG. 7A shows a detailed plan view of the isolator component which appears in FIG. 6, illustrating the location of electrodes on its upper surface.

FIG. 7A shows a plan view of the isolator included in FIG. 6, showing a possible configuration of its upper electrode. In this embodiment the upper electrode 301 is patterned such to leave windows 311 in the electrode layer where the isolator flexes between the outside edge of the actuator 40 and the side walls 15 and 22. These windows locally reduce the stiffness of the isolator, enabling it to bend more readily and thereby reducing any damping effect that the electrode layer might otherwise have on the motion of the actuator 40. An inner ring element 313 of the electrode 301 enables connection to the piezoelectric disc wrap electrode 423. The inner ring 313 is connected to an outer ring 314 by four sections 312. A further part 315 of the electrode 301 extends along a "tail" 310 to facilitate connection of the pump to a drive circuit. One skilled in the art will recognize that the lower electrode 302 may be similarly configured and the electrode patterns 302 and 301 may in fact be the same.

Figure 7B:
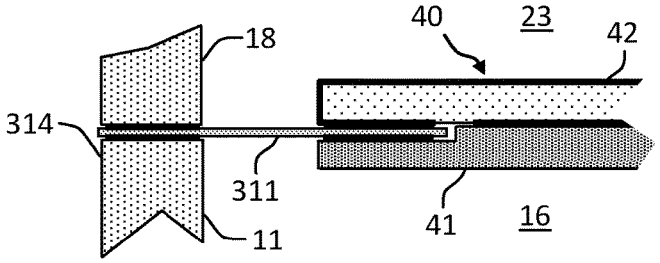
FIGS. 7B and 7C are cross section views showing further details of the combined actuator and isolator assembly shown in FIG. 6, further illustrating the configuration of electrodes.
Figure 7C:
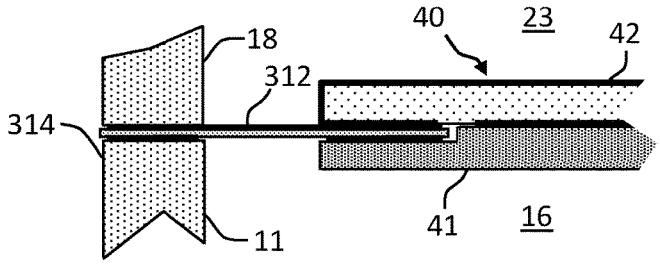

FIGS. 7B and 7C show cross-sections through the combined actuator and isolator assembly shown in FIG. 6, including mounting of the isolator between the pump body components 11 and 18. FIG. 7B shows a section through a region including a window 311. FIG. 7C shows a section through a region including electrode sections 312. Note that, as indicated in FIG. 7C, the equivalent sections on the lower electrode have been offset azimuthally, for example by 45°, such that the isolator is not made stiffer by the presence of both at the same azimuthal position. The isolator 30 may be glued, welded, clamped, or otherwise attached to the pump body components 11 and 18. All such methods are included in the terms "retained", "bonded" or "bond" used in the specification.

Figure 8A:
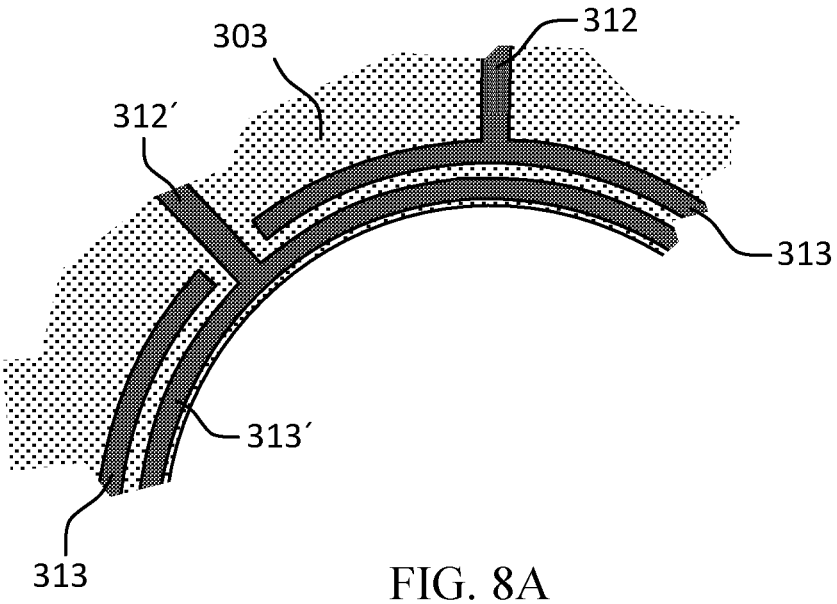
FIG. 8A shows a detail of a plan view of an alternative isolator component, illustrating the location of electrodes on its upper and lower surfaces.

FIG. 8A shows a plan view of an alternative isolator according to the present invention sowing both upper and lower electrodes. In this embodiment the electrodes are again patterned such to leave windows in the electrode layers where the isolator flexes between the outside edge of the actuator and the side walls of the cavity. The inner ring element 313 of the upper electrode is offset from the inner ring element 313' of the lower electrode. Upper electrode sections 312 and also offset azimuthally from lower electrode sections 312'. In this design the flexing of the isolator between the outside edge of the actuator and the side walls of the cavity is nowhere impeded by electrodes layers being present simultaneously on both sides of the isolator.

Figure 8B:
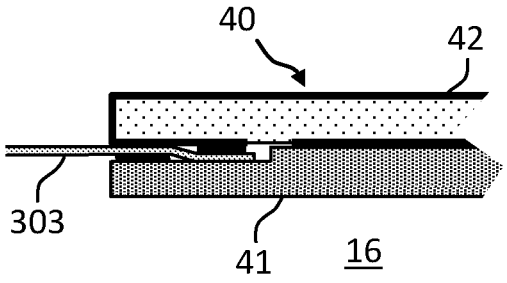
FIG. 8B is a cross section view showing further detail of a combined actuator and isolator assembly including the isolator component shown in FIG. 8A, further illustrating the configuration of electrodes.

FIG. 8B shows a further advantage of the isolator design shown in FIG. 8A. In this design the height of the step in the plate 41 may be reduced such that the isolator is forced to flex as indicated when the plates 41 and 42 are glued together. This may be advantageous to ensuring the intimate contact of and good electrical connection between the various electrodes.

The isolator 300 comprising core 303 and upper and lower electrodes 301 and 302 and further "capping" layers (not shown) may be conveniently formed using conventional flexible printed circuit board manufacturing techniques in which copper (or other conductive material) tracks are formed on a polyimide (such as Kapton) or other flexible non-conductive substrate material. Such conventional processes are capable of producing parts with the preferred dimensions listed above.

In one non-limiting example, the diameter of the piezoelectric disc 42 and the end plate 41 may be 1-2 mm less than the diameter of the cavities 16 and 23 such that the isolator 30 spans the peripheral portion of the end walls 14 and 21. The peripheral portion may be an annular gap of 0.5-1.0 mm between the edge of the actuator 40 and the side walls 15 and 22 of the cavities 16 and 23. Generally, the annular width of this gap should be relatively small compared to the cavity radius (a) such that the actuator diameter is close to the cavity diameter so that the diameter of the annular displacement node 47 is approximately equal to the diameter of the annular pressure node 57, while being large enough to facilitate and not restrict the vibrations of the actuator 40.

Figure 9:
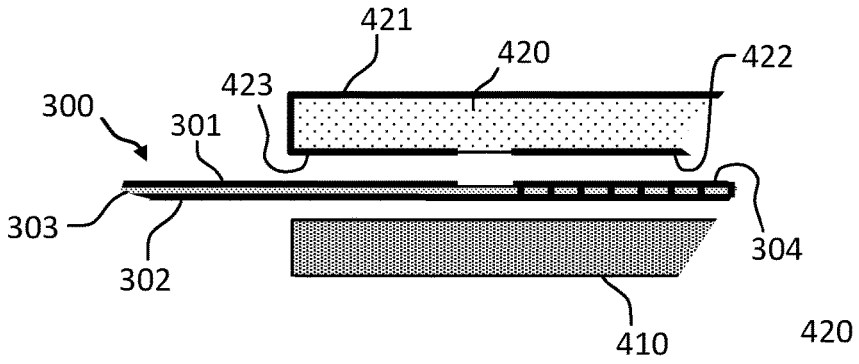
FIG. 9 shows an alternative embodiment of the present invention in which the isolator extends fully between the actuator plates in the combined actuator and isolator assembly.

An alternative embodiment of the present invention is shown in FIG. 9. In this case the isolator 300 extends fully between the piezoelectric disc 42 and the end plate 41. The isolator 300 is again comprised of a flexible, electrically non-conductive core 303 with conductive electrodes 301 and 302 on its upper and lower surfaces. The upper electrode 301 again connects with the wrap electrode 423 and thereby with the upper electrode 421 of the piezoelectric disc 420. The lower electrode 302 connects, for example by using vias (as indicated by the short black vertical lines in the Figure linking electrodes 302 and 304), through the isolator core 303 with an electrode 304 on the upper surface of the isolator and thereby with the lower electrode 422 of the piezoelectric disc 420. In this case there is no need for the end plate 410 to be formed from an electrically conductive material. This construction has the advantages that the design of the end plate 410 is simplified, and connection between the electrode 302 and the lower piezoelectric disc electrode 422 may be more reliably achieved.

Figure 10:
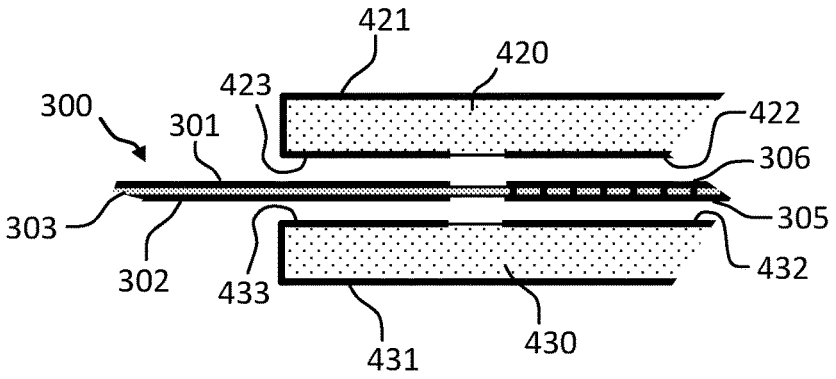
FIG. 10 shows another alternative embodiment of the present invention in which the actuator comprises two piezoelectric discs.

FIG. 10 shows a further embodiment of the present invention in which a combined actuator and isolator assembly comprises two piezoelectric elements and an isolator. The upper electrode 421 of the upper piezoelectric disc 420 is electrically connected to the electrode 301 via wrap electrode 423. The lower electrode 431 of the lower piezoelectric disc 430 is electrically connected to the electrode 302 via wrap electrode 433. The lower electrode 422 of the upper piezoelectric disc 420 is connected to the upper electrode 432 of the lower piezoelectric disc 432 by electrodes 307 and 306 which form part of the isolator part 300 and are connected together through the isolator core 303 by electrically conductive "vias". In this case the two piezoelectric discs are connected electrically in series and their polarizations must be opposite in order for the actuator to operate in the desired mode. It will be recognized by one skilled in the art that by adaptation of the isolator design is it possible to extend the electrode 306 and 307 along the tail 310 so as to enable electrical connection to a drive circuit and thereby to enable the two piezoelectric discs 420 and 430 to be driven in parallel. This configuration may be advantageous in requiring a lower drive voltage for the same amplitude of motion of the actuator.

It should be apparent that the structures, suspensions and shapes of the isolators 30 and 300 are not limited to these embodiments, but are susceptible to various changes and modifications without departing from the spirit of the inventions described herein.

In the previous embodiments of the pump 10 shown in FIGS. 1-10, the side walls 15, 22 extend continuously between the end walls 13, 20 of the cavities 16, 23, and the radius of the actuator 40 ($a_{act}$) is less than the radius of the cavities 16, 23 (a). In such embodiments, the side walls 15, 22 define uninterrupted surfaces from which the radial acoustic standing waves formed in the cavities 16, 23 are reflected during operation. However, it may be desirable for the radius of the actuator 40 ($a_{act}$) to extend all the way to the side walls 15, 22 making it about equal to the radius of the cavity (r) to ensure that the annular displacement node 47 of the displacement oscillations is more closely aligned with the annular pressure node 57 of the pressure oscillations so as to maintain more closely the mode-matching condition described above.

Figure 11:
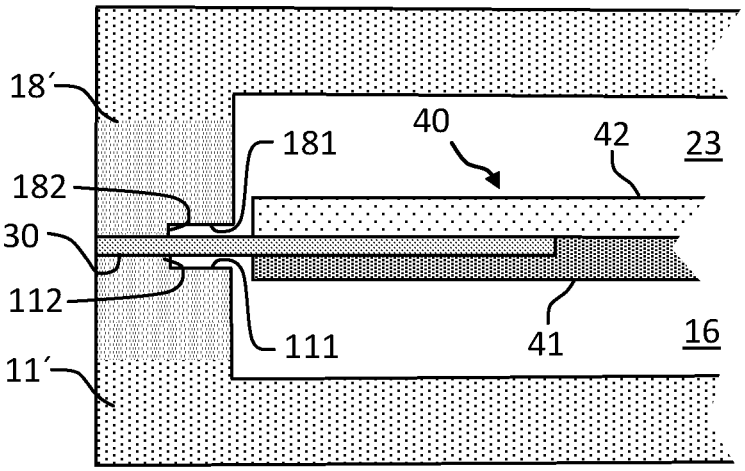
FIG. 11 shows an embodiment of a pump according to the present invention in which the side wall of the cavity includes a recess.

Referring more specifically to FIG. 11, yet another embodiment of the pump 10 is shown wherein the actuator 40 has a similar radius to the diameter of the cavities 16, 23 and is supported by an isolator 30. Because the isolator 30 must enable the edge of the actuator 40 to move freely as it bends in response to the vibration of the actuator 40, the cylindrical walls 11' and 18' of the pump body comprise annular steps 111 and 181 in the surfaces of the cylindrical walls 11' and 18' extending radially outward from the side walls 15, 22 to annular edges 112 and 182. The annular steps 111 and 181 are cut sufficiently deep into the surfaces of the cylindrical walls 11' and 18' so as not to interfere with the bending of the isolator 30 to enable the actuator 40 to vibrate freely, but not so deep as to significantly diminish the resonant quality of the cavities 16, 23 referred to above.

To ensure that the side walls 15 and 22 still define substantially uninterrupted surfaces from which the radial acoustic standing waves are reflected within the cavities 16 and 23, the depth of the steps 111 and 181 are preferably minimized. In one non-limiting example, the depth of the steps 111 and 181 may be sized to maintain so far as possible the resonant qualities of the pump cavities 16 and 23. For example, the depth of the steps 111 and 181 may be less than or equal to 10% of the height of the cavities 16 and 23.

Figure 12:
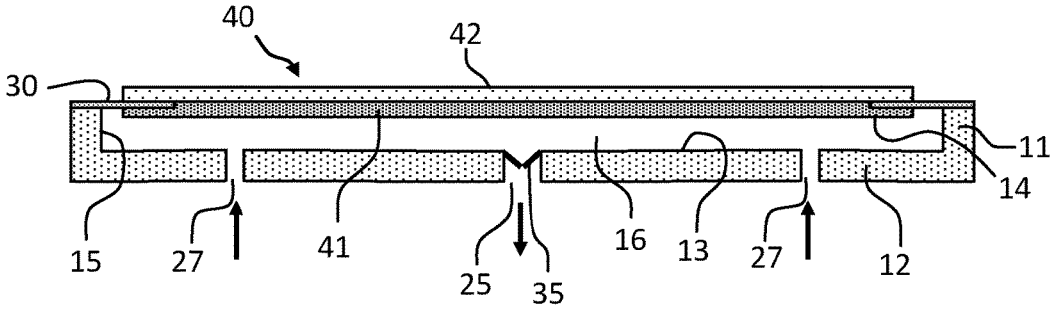
FIGS. 12 and 13 show further embodiments of pumps according to the present invention.

FIG. 12 shows yet another embodiment of the present invention in which the pump has just one cavity. In this case the combined actuator and isolator construction continues to provide the benefits of forming a strong bond between the actuator and the isolator, and of facilitating electrical connection to the actuator.

Figure 13:
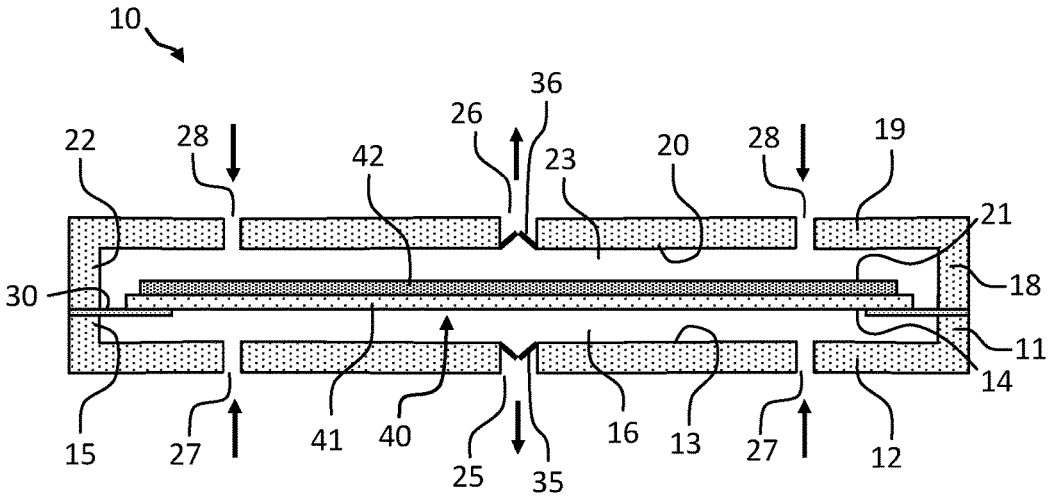

FIG. 13 shows yet another embodiment of the present invention in which the isolator 30 is no longer sandwiched between the piezoelectric plate 42 and the end plate 41, but instead bonded to the other, outer, side of the end plate 41. As an alternative to the illustrated embodiment, isolator 30 may additionally or alternatively be bonded to an outer side of the piezoelectric plate 42. While this construction may provide reduced strength of the isolator to actuator bond, it may facilitate electrical connection to the actuator in the manner described above where the piezoelectric disc includes an appropriately designed wrap electrode.

It should be apparent from the foregoing that an invention having significant advantages has been provided. While the invention is shown in only a few of its forms, it is not just limited but is susceptible to various changes and modifications without departing from the spirit thereof.

The invention claimed is:

1. A pump comprising:

a pump body having pump walls with a first substantially cylindrical shaped cavity having a side wall closed by two end walls for containing a fluid, the first cavity having a height (h) and a radius (a), wherein a ratio of the radius (a) to the height (h) is greater than about 1.2;

an actuator operatively associated with a central portion of a first of the two end walls of the first cavity and adapted to cause an oscillatory motion of said first end wall at a frequency (f) thereby generating radial pressure oscillations of the fluid within the first cavity including at least one annular pressure node in response to a drive signal being applied to said actuator;

a first aperture disposed at a location in one of the two end walls of the first cavity and extending through the pump wall;

a second aperture disposed at any location in the walls of the first cavity other than the location of the first aperture and extending through the pump wall; and a first valve disposed in one of the first and second apertures to enable the fluid to flow through the first cavity when in use;

an oscillation isolator forming at least a portion of said first end wall between the actuator and the side wall and configured to reduce damping of the oscillatory motion of the first end wall by the side wall; and a plurality of conductive tracks included in the oscillation isolator and configured to provide an electrical connection to the actuator via the oscillation isolator;

wherein the actuator comprises two layers and the isolator is either retained between the first and second layers, or joined to an outer side of either of the first and second layers;

wherein at least one of the layers of the actuator includes an upper surface on which an upper electrode is provided and a lower surface that is in contact with the isolator and on which a lower electrode is provided; and wherein the upper electrode wraps around an edge of the at least one layer onto a portion of the lower surface, thus providing an electrical contact with at least one of the plurality of conductive tracks of the isolator.

2. The pump according to claim 1 further comprising:

a second substantially cylindrical shaped cavity having a side wall closed by two end walls for containing a fluid, the second cavity having a height (h) and a radius (a), wherein a ratio of the radius (a) to the height (h) is greater than about 1.2;

a third aperture disposed at a location in one of the two end walls of the second cavity and extending through the pump wall;

a fourth aperture disposed at any location in the walls of the second cavity other than the location of the first aperture and extending through the pump wall; and a second valve disposed in one of the third and fourth apertures to enable the fluid to flow through the second cavity when in use; and an isolator forming at least a portion of the first end wall between the actuator and the side wall and including conductive tracks wherein the actuator is operatively associated with a central portion of one of the two end walls of the second cavity and adapted to cause an oscillatory motion of the one end wall at a frequency (f) thereby generating radial pressure oscillations of the fluid within the second cavity including at least one annular pressure node in response to a drive signal being applied to said actuator.

3. The pump according to claim 2 wherein the two cavities are configured for parallel pumping operation.

4. The pump according to claim 2 wherein the two cavities are configured for series pumping operation.

5. The pump according to claim 1, wherein the pump includes a first layer which is active and a second layer which is passive.

6. The pump according to claim 1, wherein both layers are active layers.

7. The pump according to claim 1, wherein the layers are a piezoelectric disc and either an end plate or another piezoelectric disc.

8. The pump according to claim 7 wherein the piezoelectric disc is formed from one of piezoelectric material or an electrostrictive or magnetostrictive material.

9. The pump according to claim 1 wherein the actuator diameter is less than the cavity diameter(s), and where the cavity side wall(s) extend continuously between the cavity end walls.

10. The pump according to claim 1, wherein a recess or recesses is provided in the pump body such that the isolator is free to move between the outer edge of the actuator and its connection to the side wall.

11. The pump according to claim 1 in which the total isolator thickness is between 10 microns and 200 microns.

12. The pump according to claim 1, wherein, in use, the motion of the driven end wall(s) and the pressure oscillations in the cavity or cavities are mode-shape matched and the frequency of the oscillatory motion is within 20% of the lowest resonant frequency of radial pressure oscillations in each cavity.

13. The pump according to claim 1, wherein the ratio a/h is greater than 20.

14. The pump according to claim 1, wherein the volume of each cavity is less than 10 ml.

15. The pump according to claim 1, wherein, in use, the frequency of the oscillatory motion is equal to the lowest resonant frequency of radial pressure oscillations in the each cavity.

16. The pump according to claim 1, wherein, in use, the lowest resonant frequency of radial fluid pressure oscillations in each cavity is greater than 500 Hz.

17. The pump according to claim 1, wherein the end wall motion is mode-shape matched to the pressure oscillation in each cavity.

18. The pump according to claim 1, wherein any unvalved apertures in the cavity walls are located at a distance of between 0.43a and 0.83a, more preferably at 0.63a from the centre of each cavity, where a is the cavity radius of that cavity.

* * * * *